US007965253B2

(12) United States Patent
Lai

(10) Patent No.: US 7,965,253 B2
(45) Date of Patent: Jun. 21, 2011

(54) BROADBAND ANTENNA

(75) Inventor: Po-Chih Lai, Taipei (TW)

(73) Assignees: Lite-On Technology Corporation, Taipei (TW); Silitek Electronic (GZ) Co., Ltd., Guangzhou (CN)

( * ) Notice: Subject to any disclaimer, the term of this patent is extended or adjusted under 35 U.S.C. 154(b) by 38 days.

(21) Appl. No.: 12/155,355

(22) Filed: Jun. 3, 2008

(65) Prior Publication Data

US 2009/0184878 A1 Jul. 23, 2009

(30) Foreign Application Priority Data

Jan. 18, 2008 (TW) ..... 97102100 A

(51) Int. Cl.
*H01Q 1/48* (2006.01)

(52) U.S. Cl. ..... 343/845; 343/702

(58) Field of Classification Search ..... 343/845, 343/700 MS, 702
See application file for complete search history.

(56) References Cited

U.S. PATENT DOCUMENTS

| | | | | |
|---|---|---|---|---|
| 4,827,266 | A * | 5/1989 | Sato et al. | 343/700 MS |
| 7,292,193 | B2 * | 11/2007 | Jang | 343/702 |
| 7,385,556 | B2 * | 6/2008 | Chung et al. | 343/700 MS |
| 7,450,072 | B2 * | 11/2008 | Kim et al. | 343/700 MS |
| 7,750,866 | B2 * | 7/2010 | Rambeau et al. | 343/866 |
| 2009/0303144 | A1 * | 12/2009 | Hirano | 343/750 |

OTHER PUBLICATIONS

P.K. Panayi, M. Al-Nuaimi, L. P. Ivrissimtzis, Tuning Techmiques for the Planar Inverted-F Antenna, Electronic Letters, vol. 37, No. 16, Aug. 2001, pp. 1003-1004.*

* cited by examiner

*Primary Examiner* — Jacob Y Choi
*Assistant Examiner* — Kyana R Robinson
(74) *Attorney, Agent, or Firm* — Rosenberg, Klein & Lee

(57) ABSTRACT

A broadband antenna including an antenna body, a ground plane, and a bandwidth adjustment portion is described. The bandwidth adjustment portion, formed by at least one capacitor, is connected between the antenna body and the ground plane. The bandwidth adjustment portion is formed by more than one capacitor connected in series. Also, in another situation, the bandwidth adjustment portion can be formed by more than one capacitor connected in parallel.

11 Claims, 7 Drawing Sheets

BROADBAND ANTENNA

CROSS-REFERENCE TO RELATED APPLICATIONS

This non-provisional application claims priority under 35 U.S.C. §119(a) on Patent Application No(s). 097102100 filed in Taiwan, R.O.C. on Jan. 18, 2008 the entire contents of which are hereby incorporated by reference.

BACKGROUND OF THE INVENTION

1. Field of Invention

The present invention relates to a broadband antenna, and more particular to a broadband antenna having a bandwidth adjustment portion for broadening the bandwidth thereof.

2. Related Art

Antenna is a coupling element or a conductive system used for converting electrical signals in a circuit into electromagnetic energy in the air, and vice versa. When transmitting signals, the antenna converts the electrical energy of a radio frequency into electromagnetic energy for being radiated to the surrounding environment. When receiving signals, the antenna receives and converts the electromagnetic energy into the electrical energy of a radio frequency for being processed in a receiver.

Wireless communication standards all have a transmitting/receiving end, and an antenna is required to covert radio waves in the air into electrical signals no matter in the process of reception or transmission. To match a gradually scaled down mobile device mechanism, the appearance and volume of the antenna become increasingly compacted. For example, in the very beginning, the antenna for a cell phone is exposed to the outside, and later is shrunk in the phone. Moreover, as the size of the cell phone is gradually reduced, the exposed portion of the antenna changes from a protrusion of 5 to 10 cm to less than 3 cm, and is further integrated into the circuit board afterwards.

However, as different wireless communication standards generally have different wavelengths, the transceiver may be designed as common, but the antenna must be fabricated according to actual requirements. Under the current trend of increasingly higher integration and the miniaturization of system mechanism, appropriate antenna designs and combinations of various types of antennae are the key to the product performance.

In view of the cost, the antenna of a wireless product is usually in the form of a flat panel antenna, which often has an insufficient bandwidth due to limits on the area and PCB characteristics. Besides, the bandwidth may affect the yield and performance of the wireless product. Therefore, limited by the area of the antenna, it is a critical manner to broaden the bandwidth of the antenna to improve the yield and performance of the wireless product.

SUMMARY OF THE INVENTION

Accordingly, the present invention is directed to a broadband antenna, in which a bandwidth adjustment portion is connected between the antenna body and the ground plane, so as to achieve a bandwidth wider than that of the antenna disclosed in the prior art.

According to an embodiment of the present invention, a broadband antenna includes an antenna body, a ground plane, and a bandwidth adjustment portion. The antenna body is formed by a first conductor, a second conductor, and a third conductor. The second conductor has a first end connected to the first conductor, and the third conductor has a first end connected to the first conductor. The ground plane is connected to a second end of the third conductor. The bandwidth adjustment portion is connected between the third conductor and the ground plane.

According to an embodiment of the present invention, the bandwidth adjustment portion is formed by at least one capacitor. According to an embodiment of the present invention, the bandwidth adjustment portion is formed by more than one capacitor connected in series.

According to another embodiment of the present invention, a broadband antenna includes an antenna body, a ground plane, and a bandwidth adjustment portion. The antenna body is formed by a first conductor and a second conductor. The second conductor has a first end connected to a first end of the first conductor. The bandwidth adjustment portion is connected between the second conductor and the ground plane.

According to an embodiment of the present invention, the bandwidth adjustment portion is formed by at least one capacitor. According to an embodiment of the present invention, the bandwidth adjustment portion is formed by more than one capacitor connected in parallel.

According to an embodiment of the present invention, without increasing the area of the antenna, a bandwidth adjustment portion is disposed between the antenna and the ground plane to broaden the bandwidth of the antenna, such that the wireless communication product can operate in a broadband environment. It is known from a realistic simulation test that, the antenna structure disclosed in the present invention can indeed broaden the operating bandwidth of the antenna.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The detailed features and advantages of the present invention will be described in detail in the following embodiments. Those skilled in the arts can easily understand and implement the content of the present invention. Furthermore, the relative objectives and advantages of the present invention are apparent to those skilled in the arts with reference to the content disclosed in the specification, claims, and drawings. The embodiments below are only used to illustrate the features of the present invention, instead of limiting the scope of the same.

Figure 1:
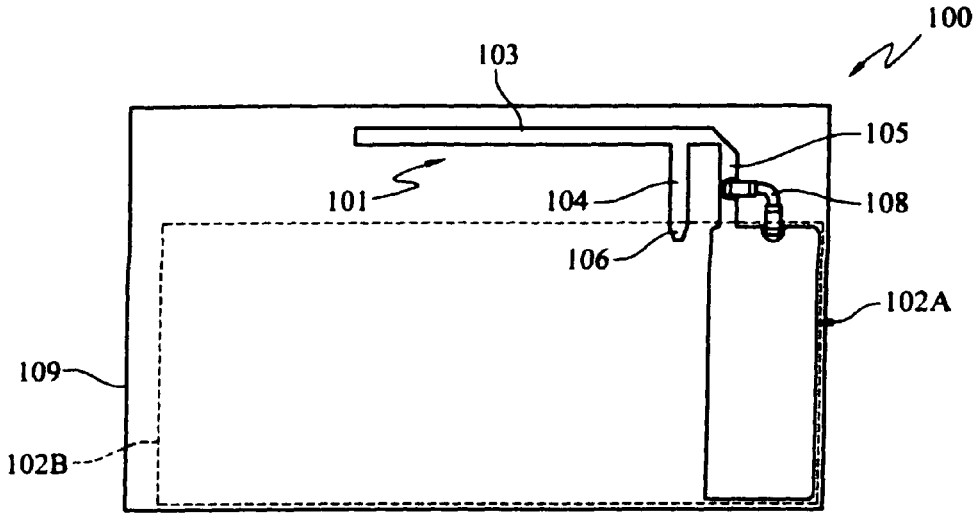
FIG. 1 shows a broadband antenna according to a first embodiment of the present invention.

FIG. 1 shows a broadband antenna according to a first embodiment of the present invention. Referring to FIG. 1, the broadband antenna 100 is formed by an antenna body 101, a ground plane 102A, and a ground plane 102B. A radiation signal of the antenna is fed in through a feed-in point 106, and the signal received by the antenna is also fed out through the feed-in point 106. The ground plane 102A and the ground plane 102B are respectively disposed on two surfaces of a substrate 109, and may be connected via a through hole (not shown). In another embodiment, only the ground plane 102B is disposed, and in this circumstance, the ground plane 102B may also be connected to the antenna body 101 via a through hole.

The antenna body 101 is formed by a first conductor 103, a second conductor 104, and a third conductor 105. The first conductor 103, the second conductor 104, and the third conductor 105 are stripped metal wires and respectively have a first end and a second end. The first end of the second conductor 104 is connected to a predetermined position of the first conductor 103. The first end of the third conductor 105 is connected to the second end of the first conductor 103. The second end of the third conductor 105 is connected to the ground plane 102A, and is further electrically connected to the ground plane 102B via a through hole. The first end of the first conductor 103 is open. The ground plane 102A and the ground plane 102B may be connected via a through hole. The feed-in point 106 is disposed at the second end of the second conductor 104.

In this embodiment, the second conductor 104 and the third conductor 105 are approximately disposed in parallel. The second conductor 104 and the third conductor 105 are disposed perpendicular to the first conductor 103. The antenna formed by the first conductor 103, the second conductor 104, and the third conductor 105 may be defined as an inverted-F antenna. It should be specifically noted that, the arrangement of the first conductor 103, the second conductor 104, and the third conductor 105 is not limited to the inverted-F antenna.

According to the present invention, in order to broaden the bandwidth of the antenna, a bandwidth adjustment portion 108 is connected between a predetermined position of the third conductor and the ground plane 102A. Wherein, one end of the bandwidth adjustment portion is connected to the predetermined position of the third conductor, and the other end of the bandwidth adjustment portion is connected to the ground plane 102A. In an embodiment, the bandwidth adjustment portion 108 is formed by more than one capacitor. In another embodiment, the bandwidth adjustment portion 108 is formed by two capacitors connected in series.

In an embodiment, the antenna body 101, the ground plane 102, the feed-in point 106, and the bandwidth adjustment portion 108 are disposed on a substrate 109. The substrate 109 is generally, but not limited to, a printed circuit board (PCB), for example, a glass fiber (FR4) substrate.

Figure 2:
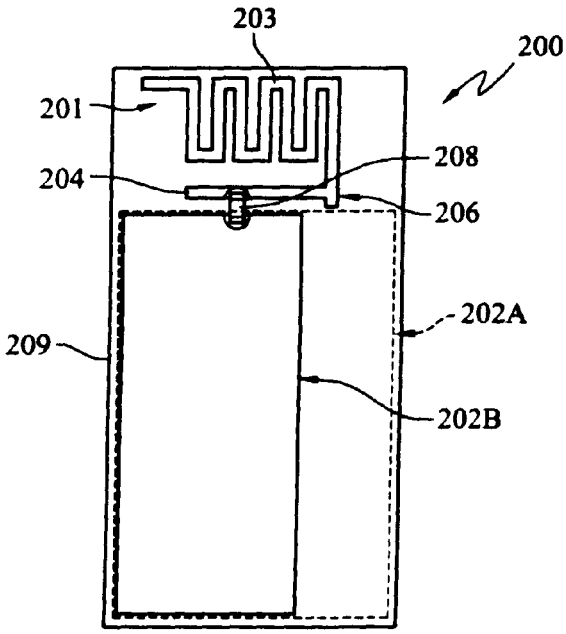
FIG. 2 shows a broadband antenna according to a second embodiment of the present invention.

FIG. 2 shows a broadband antenna according to a second embodiment of the present invention. Referring to FIG. 2, the broadband antenna 200 is formed by an antenna body 201, a ground plane 202A, and a ground plane 202B. A radiation signal of the antenna is fed in through a feed-in point 206, and the signal received by the antenna is also fed out through the feed-in point 206. The ground plane 202A and the ground plane 202B are respectively disposed on two surfaces of a substrate 209, and may be connected via a through hole (not shown). In another embodiment, only the ground plane 202B is disposed, and in this circumstance, the ground plane 202B may also be connected to the antenna body 201 via a through hole.

The antenna body 201 is formed by a first conductor 203 and a second conductor 204. The first conductor 203 is presented as a serpentine metal wire, and the second conductor is a stripped metal wire. The first conductor 203 and the second conductor 204 respectively have a first end and a second end. The first end of the second conductor 204 is connected to the first end of the first conductor 203, the second end of the first conductor 203 is open, and the second end of the second conductor 204 is connected to the ground plane 202B via a through hole. In addition, the ground plane 202A and the ground plane 202B may be connected via a through hole.

According to the present invention, in order to broaden the bandwidth of the antenna, a bandwidth adjustment portion 208 is connected between a predetermined position of the second conductor and the ground plane 202A. Wherein, one end of the bandwidth adjustment portion is connected to the predetermined position of the second conductor, and the other end of the bandwidth adjustment portion is connected to the ground plane 202A.

In an embodiment, the bandwidth adjustment portion 208 is formed by more than one capacitor. In another embodiment, the bandwidth adjustment portion 208 is formed by more than one capacitor connected in parallel.

In an embodiment, the antenna body 201, the ground plane 202, the feed-in point 206, and the bandwidth adjustment portion 208 are disposed on a substrate 209. The substrate 209 is generally, but not limited to, a PCB, for example, a glass fiber (FR4) substrate.

Figure 3:
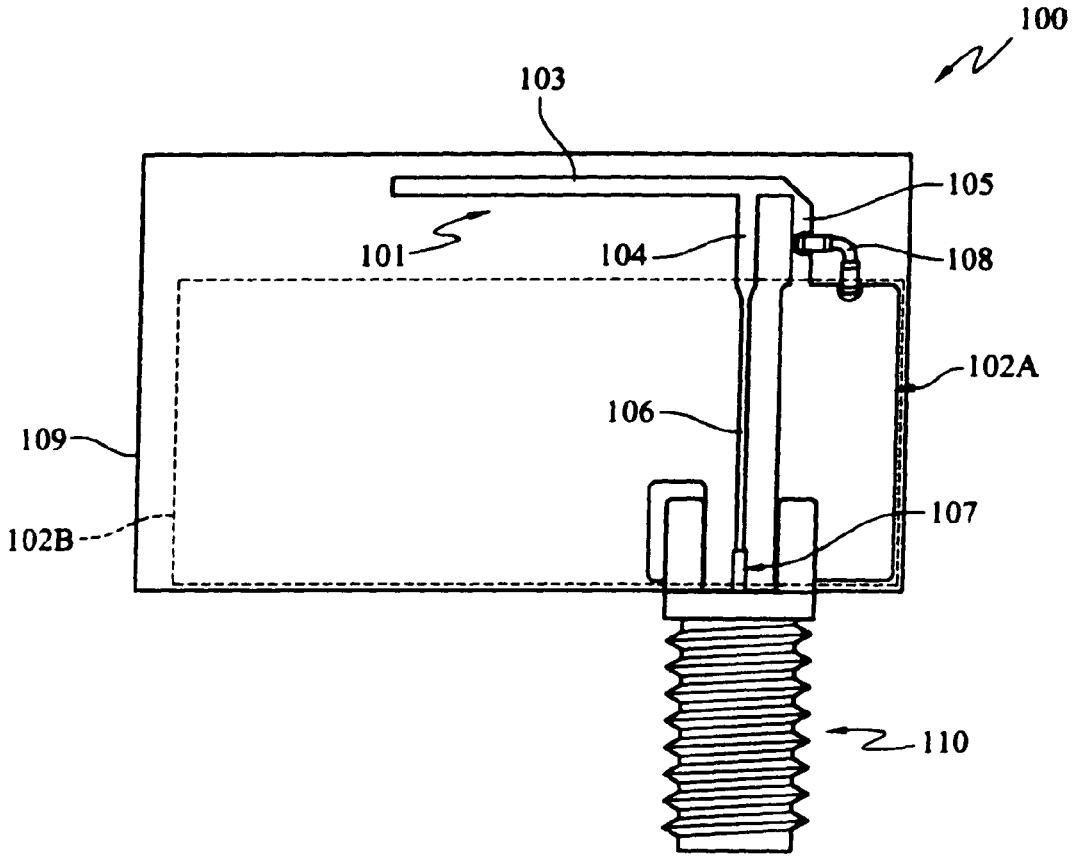
FIG. 3 is a schematic structural view of the broadband antenna under test according to the first embodiment of the present invention.
Figure 5A:
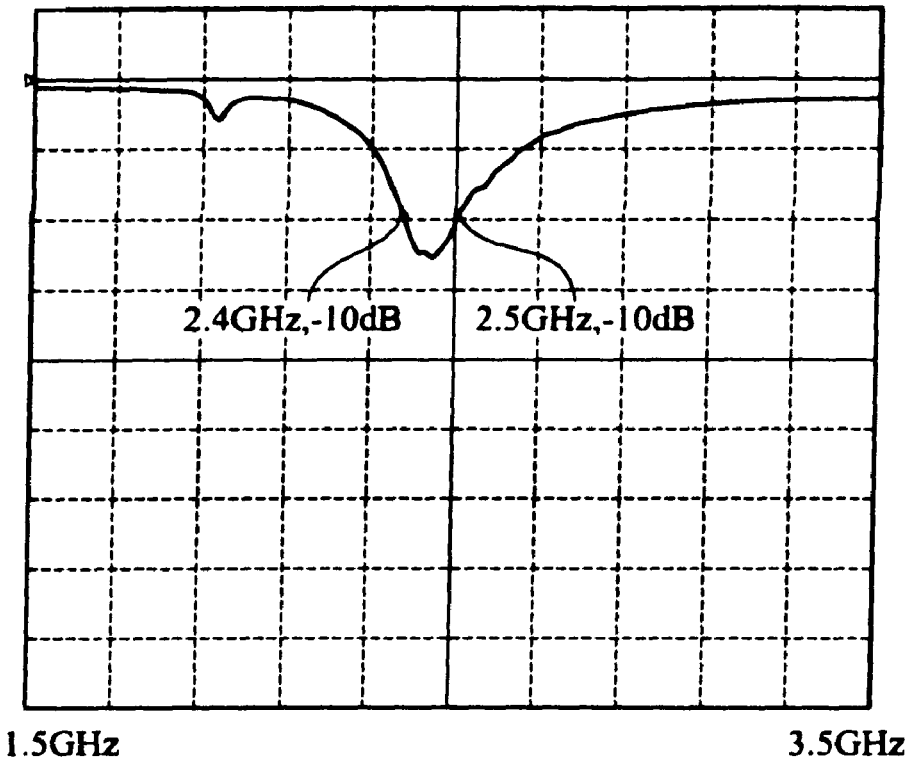
FIG. 5A shows measured bandwidths of an antenna formed with no bandwidth adjustment portion.
Figure 5B:
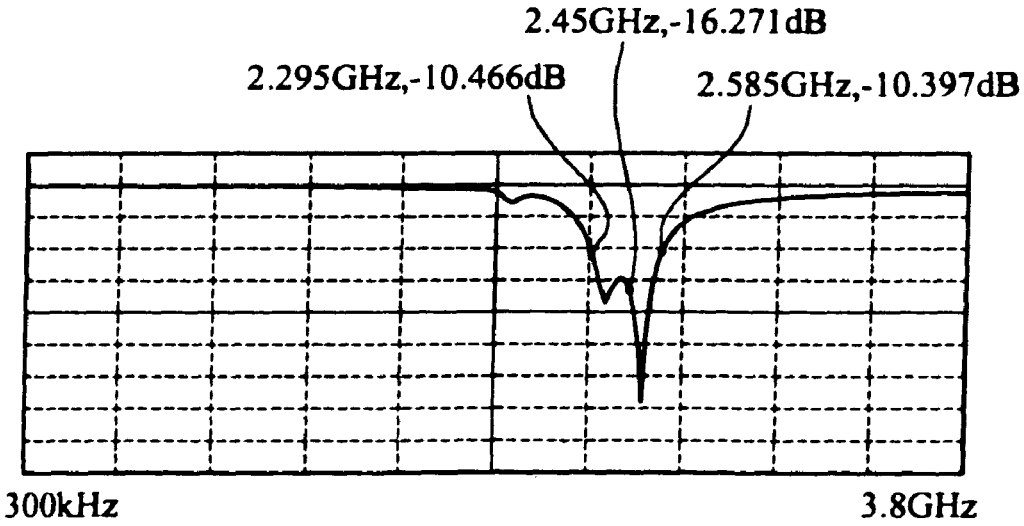
FIG. 5B shows measured bandwidths of the antenna formed with a bandwidth adjustment portion according to the first embodiment of the present invention.

Referring to FIGS. 5A and 5B, FIG. 5A shows a bandwidth test on the antenna structure of FIG. 1 but formed with no bandwidth adjustment portion, and FIG. 5B shows a bandwidth test on the antenna structure of FIG. 1. During the test, as shown in FIG. 3, a transmission line 107, formed by a conductive material, is added to the antenna structure of FIG. 1. A signal transmission line connector 110 is selectively disposed on a side edge of the substrate 109. The signal transmission line connector 110 has a housing made of a metal material, and is electrically connected to the ground plane 102A by means of (but not limited to) welding. The signal transmission line connector 110 has a metal connection portion for connecting a signal transmission line. The metal connection portion is isolated from the housing by an insulating layer disposed there-between. If a return loss is set as 10 dB, the bandwidth shown in FIG. 5A is 100 MHz, and the bandwidth shown in FIG. 5B is 290 MHz.

The antenna shown in FIG. 1 is equivalent to an inductor L, and the added bandwidth adjustment portion is equivalent to a capacitor. The antenna and the bandwidth adjustment portion are connected in parallel and obtain an impedance Y as follows:

$Y=jwC+1/jwL=j(wC-1/wL)$, where w is a resonating frequency, C is an equivalent capacitance, and L is an equivalent inductance.

Figure 6A:
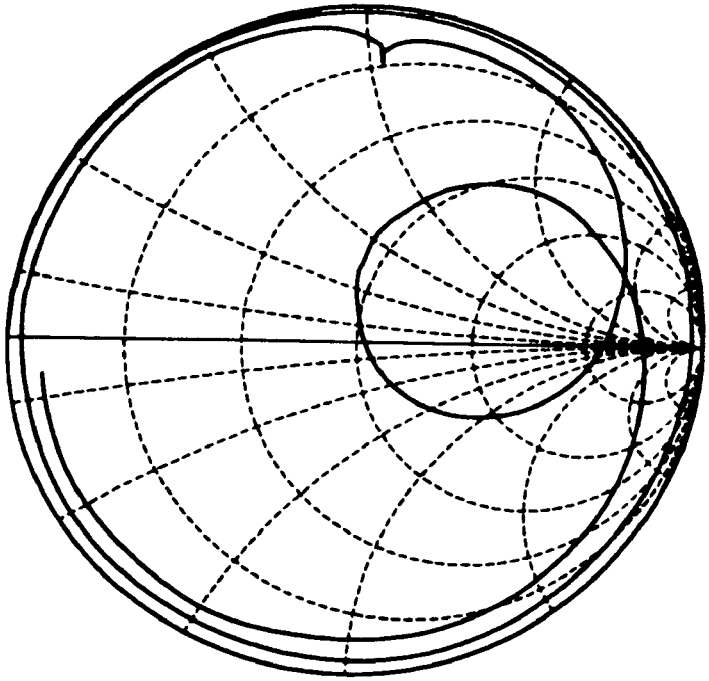
FIG. 6A is a Smith chart of an antenna formed with no bandwidth adjustment portion.
Figure 6B:
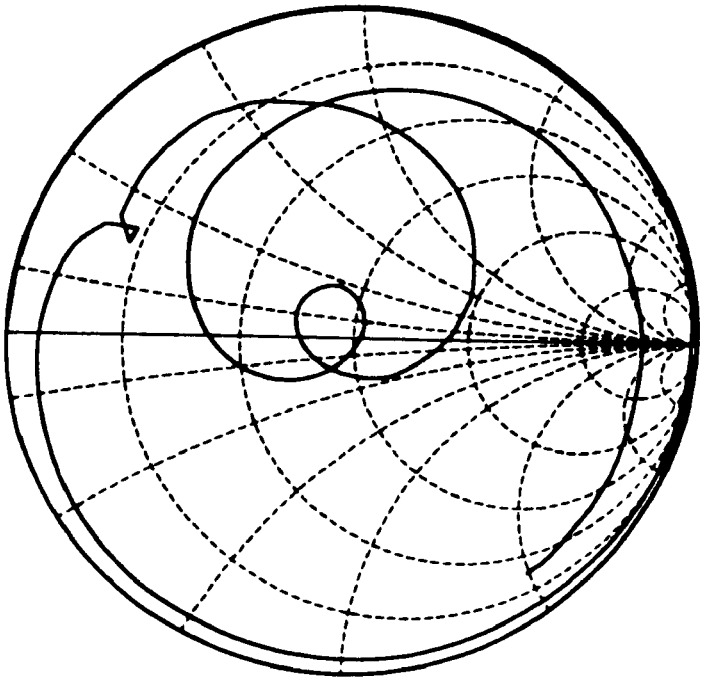
FIG. 6B is a Smith chart of an antenna formed with a bandwidth adjustment portion.

Referring to FIGS. 6A and 6B, FIG. 6A is a Smith chart of the antenna structure of FIG. 1 but formed with no bandwidth adjustment portion, and FIG. 6B is a Smith chart of the antenna structure of FIG. 1 formed with a bandwidth adjustment portion. If the resonating frequency is $w_0$, then $Y=0$, and when $w<w_0$, then $Y=-jB$, while when $w>w_0$, then $Y=+jB$. The Smith chart at this time is shown in FIG. 6A. When the resonating cavity and the antenna are connected in parallel, the imaginary part in the equivalent impedance may be eliminated by adjusting the values of L and C. The Smith chart at this time is shown in FIG. 6B. It can be seen from the two charts that, FIG. 6A shows a track passing through an origin of 50 ohm with a large circular arc, and FIG. 6B shows a track forming a small circle around an origin of 50 ohm. Therefore, according to the two Smith charts, the bandwidth of the antenna formed with a bandwidth adjustment portion is larger than that of the antenna with no bandwidth adjustment portion.

Figure 4:
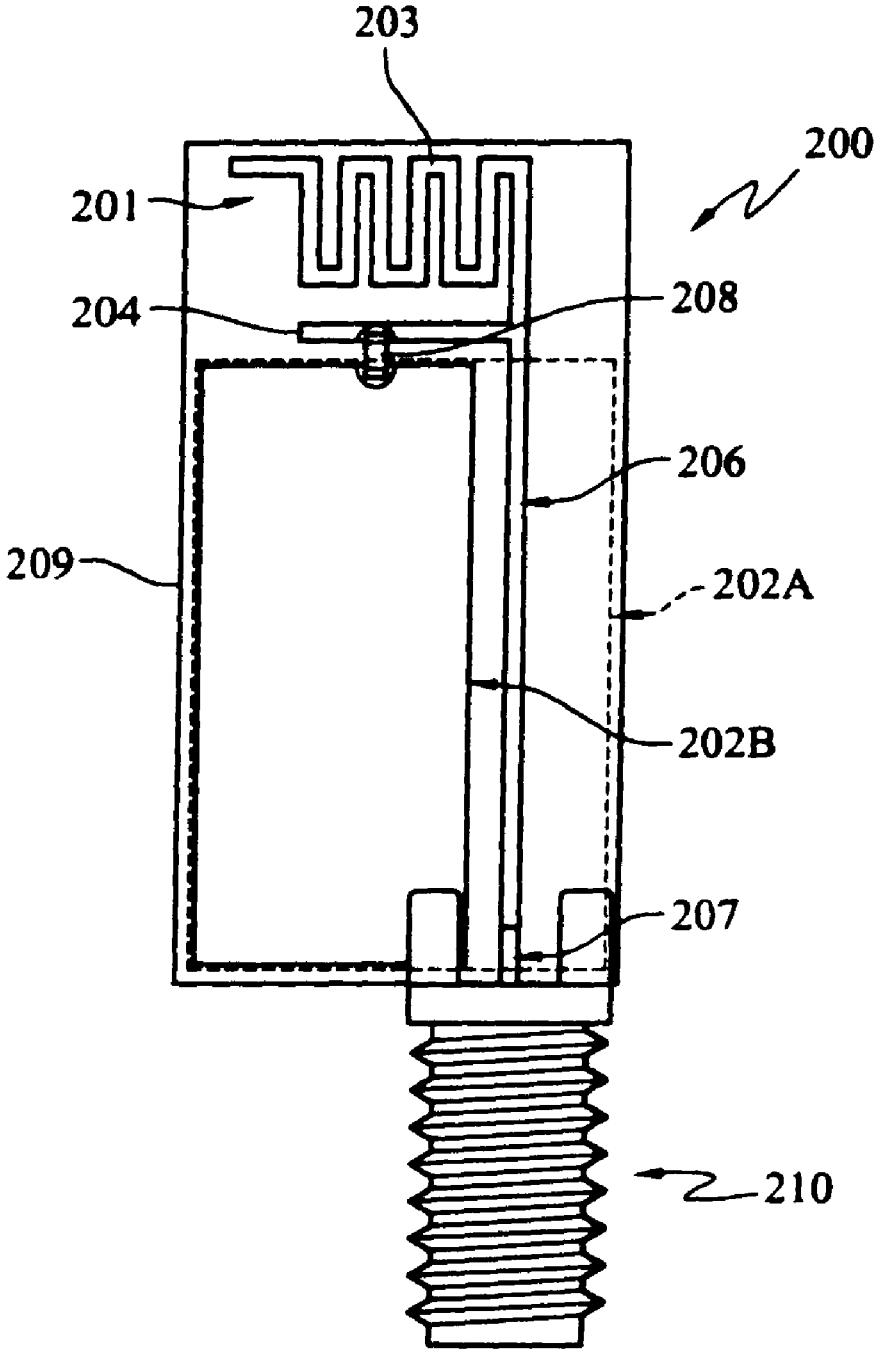
FIG. 4 is a schematic structural view of the broadband antenna under test according to the second embodiment of the present invention.
Figure 7A:
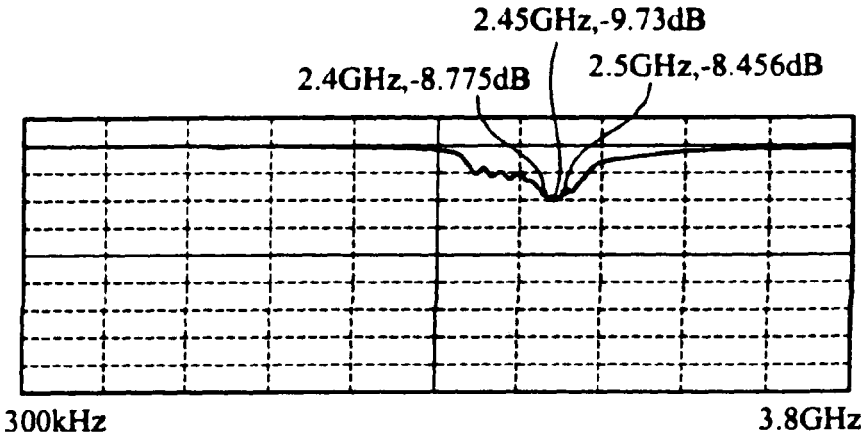
FIG. 7A shows measured bandwidths of an antenna formed with no bandwidth adjustment portion.
Figure 7B:
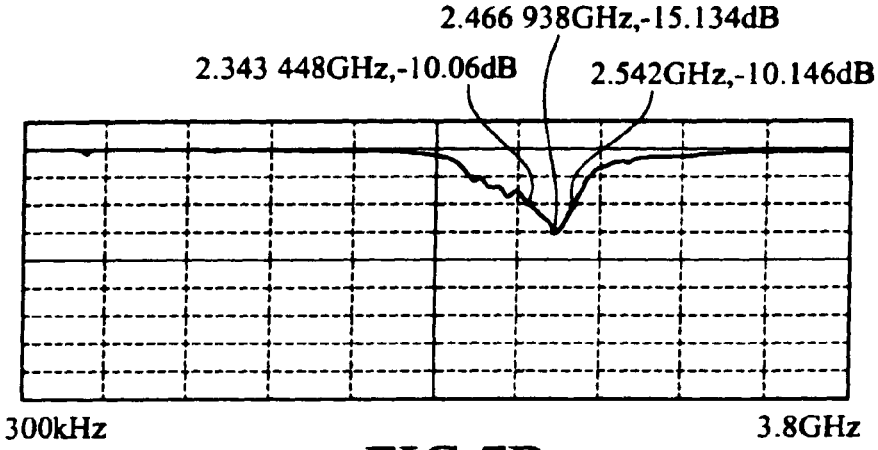
FIG. 7B shows measured bandwidths of the antenna formed with a bandwidth adjustment portion according to the second embodiment of the present invention.

Referring to FIGS. 7A and 7B, FIG. 7A shows a bandwidth test on the antenna structure of FIG. 2 but formed with no bandwidth adjustment portion, and FIG. 7B shows a bandwidth test on the antenna structure of FIG. 2 formed with a bandwidth adjustment portion formed by three capacitors connected in parallel. During the test, as shown in FIG. 4, a transmission line 207, formed by a conductive material, is added to the antenna structure of FIG. 2. A signal transmission line connector 210 is selectively disposed on a side edge of the substrate 209. The signal transmission line connector 210 has a housing made of a metal material, and is electrically connected to the ground plane 202A by means of (but not limited to) welding. The signal transmission line connector 210 has a metal connection portion for connecting a signal transmission line. The metal connection portion is isolated from the housing by an insulating layer disposed there-between. It can be known from the test results that, if a return loss is set as 10 dB, the bandwidth shown in FIG. 7A is 100 MHz, and the bandwidth shown in FIG. 7B is 200 MHz.

Figure 7C:
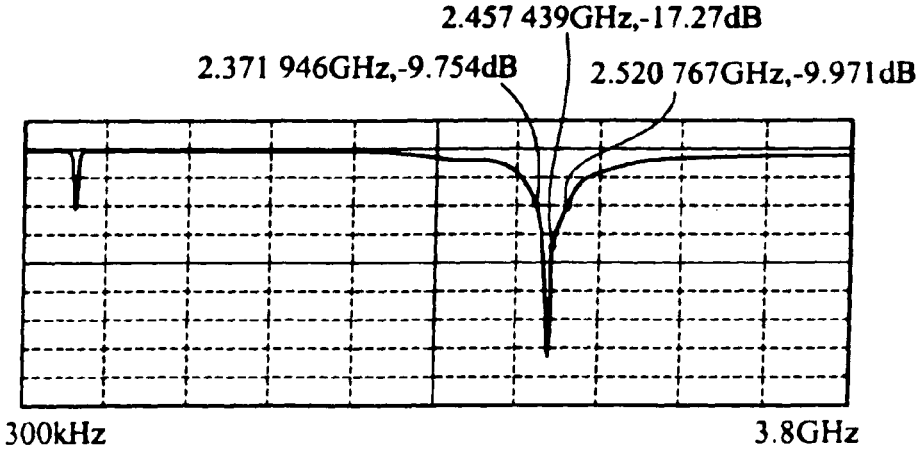
FIG. 7C shows measured bandwidths of the antenna formed with a bandwidth adjustment portion according to the second embodiment of the present invention.

The bandwidth shown in FIG. 7A is 100 MHz, and the bandwidth shown in FIG. 7B is 200 MHz. Even if the bandwidth adjustment portion 208 is only formed by one capacitor, the antenna structure disclosed in the present invention can still broaden the bandwidth. As shown in FIG. 7C, the bandwidth is 160 MHz.

Figure 8A:
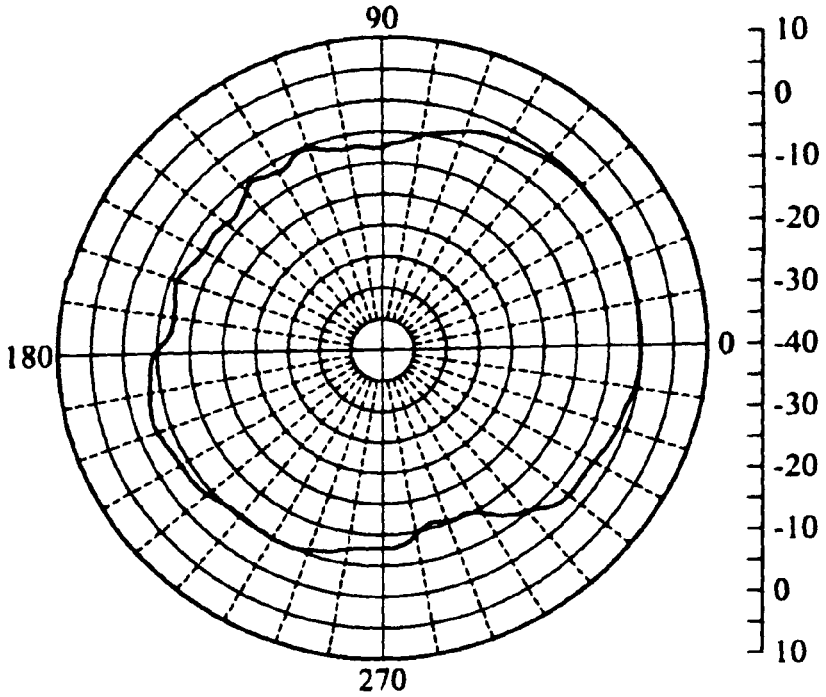
FIG. 8A is a field pattern of an antenna formed with no bandwidth adjustment portion.
Figure 8B:
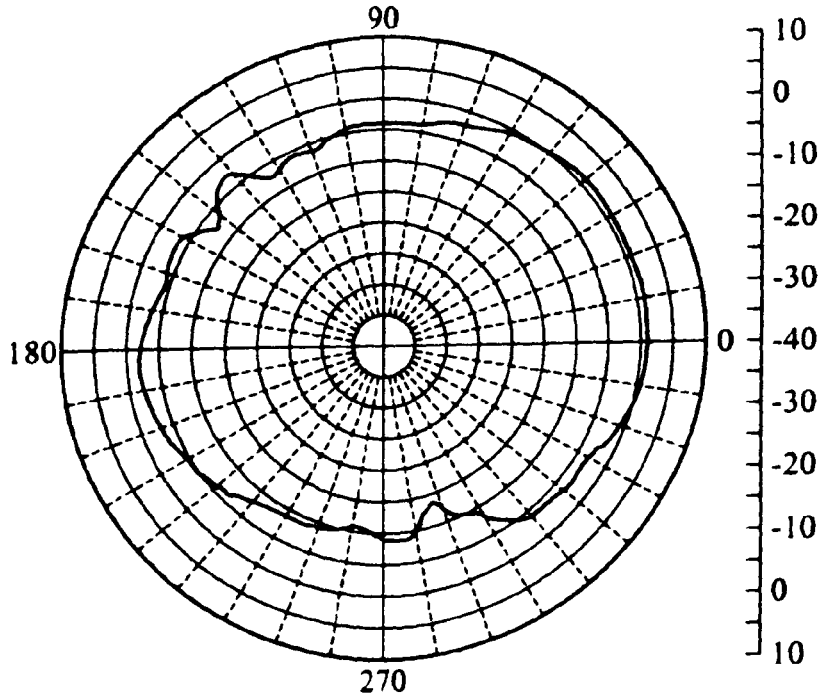
FIG. 8B is a field pattern of the antenna formed with a bandwidth adjustment portion according to the first embodiment of the present invention.

Referring to FIGS. 8A and 8B, FIG. 8A shows a field pattern test on the antenna structure of FIG. 1 but formed with no bandwidth adjustment portion, and FIG. 8B shows a field pattern test on the antenna structure of FIG. 1. It can be seen by comparing FIGS. 8A and 8B that, the bandwidth adjustment portion disclosed in the present invention nearly has no impact on the original field pattern of the antenna.

According to the embodiments of the present invention, without increasing the area of the antenna, a bandwidth adjustment portion is disposed between the antenna and the ground plane to broaden the bandwidth of the antenna, such that the wireless communication product can operate be operated in a broadband environment. It is known from a realistic simulation test that, the antenna structure disclosed in the present invention can indeed broaden the operating bandwidth of the antenna. Thereby, in the circumstances of errors, substrate aging, or temperature change occurring in the fabrication process, the antenna can still work at an operating bandwidth, and thus the characteristics thereof are greatly enhanced.

What is claimed is:

1. A broadband antenna, comprising:

an antenna body, formed by a first conductor having an open end, a second conductor, and a third conductor, wherein the second conductor has a first end connected to the first conductor, and the third conductor has a first end connected to the first conductor;

a feed-in point, connected to a second end of the second conductor;

a ground plane, connected to a second end of the third conductor; and a bandwidth adjustment portion coupled to an intermediate portion of the third conductor to form an additional path to the ground plane therefrom, said bandwidth adjustment portion including at least two capacitors connected in series, respective ends of the bandwidth adjustment portion being directly connected to the intermediate portion of the third conductor and the ground plane.

2. The broadband antenna according to claim 1, wherein the second conductor and the third conductor are approximately disposed in parallel.

3. The broadband antenna according to claim 1, wherein the second conductor and the third conductor are disposed perpendicular to the first conductor.

4. The broadband antenna according to claim 1, wherein the antenna body, the ground plane, the feed-in point, and the bandwidth adjustment portion are disposed on a surface of a substrate.

5. The broadband antenna according to claim 4, further comprising another ground plane disposed on another surface of the substrate.

6. A broadband antenna, comprising:

at least one ground plane;

an antenna body formed by a plurality of conductor sections, a first of the conductor sections terminating at an open first end, and a second of the conductor sections extending from a second end of the first conductor section, said second conductor section having an end thereof connected to the ground plane;

a feed-in point defined on the antenna body; and, a bandwidth adjustment portion coupled to an intermediate portion of the second conductor section to form an additional path to the ground plane therefrom, said bandwidth adjustment portion including at least one capacitor, respective ends of the bandwidth adjustment portion being directly connected to the intermediate portion of the second conductor section and the ground plane.

7. The broadband antenna according to claim 6, wherein the bandwidth adjustment portion comprises a plurality of capacitors.

8. The broadband antenna according to claim 7, wherein the bandwidth adjustment portion comprises two capacitors connected in series.

9. The broadband antenna according to claim 6, wherein the first conductor section is formed by a serpentine metal wire.

10. The broadband antenna according to claim 6, wherein the antenna body, the ground plane, the feed-in point, and the bandwidth adjustment portion are disposed on a surface of a substrate.

11. The broadband antenna according to claim 10, further comprising a second ground plane disposed on opposite surface of the substrate.

* * * * *